US005220692A

United States Patent [19]

Cox

[11] Patent Number: 5,220,692

[45] Date of Patent: Jun. 22, 1993

[54] DRIVER'S APRON

[76] Inventor: Lamar Cox, 7327 14th St., NW., Washington, D.C. 20012

[21] Appl. No.: 900,586

[22] Filed: Jun. 18, 1992

[51] Int. Cl.[5] ..... A41D 13/04

[52] U.S. Cl. ..... 2/48; 2/46; 2/51; 2/52

[58] Field of Search ..... 2/2, 46, 47, 48, 49 R, 2/49 A, 50, 51, 52, 69, 79, 94, 247, 250, 251, 252, 273, 256, DIG. 6; 5/498; 24/303; 224/258, 202, 901

[56] References Cited

U.S. PATENT DOCUMENTS

| | | | |
|---|---|---|---|
| 1,497,756 | 6/1924 | Jones | 2/52 X |
| 1,793,737 | 2/1931 | Estes | 2/46 X |
| 2,319,292 | 5/1943 | Boggs | 24/303 |
| 2,423,002 | 6/1947 | Bray | 2/52 |
| 2,648,845 | 8/1953 | Berman | 2/48 |
| 2,683,880 | 7/1954 | Krigbaum | 2/48 |
| 3,016,544 | 1/1962 | Pinkney | 2/48 |
| 3,306,610 | 2/1967 | Biggs, Jr. et al. | 482/105 |
| 3,588,105 | 6/1971 | Donohoe | 482/105 X |
| 4,014,045 | 3/1977 | Moyer | 2/51 |
| 4,242,769 | 1/1981 | Rayfield et al. | 2/79 X |
| 4,326,706 | 4/1982 | Guthrie et al. | 482/105 |
| 4,384,369 | 5/1983 | Prince | 482/105 X |
| 4,660,224 | 4/1987 | Ashcraft | 2/48 |
| 5,033,117 | 7/1991 | Fairweather | 482/105 X |
| 5,052,055 | 10/1991 | Mysliwiec | 2/51 X |
| 5,107,545 | 4/1992 | Potter | 2/46 |
| 5,123,120 | 6/1992 | Ross | 2/51 X |
| 5,127,106 | 7/1992 | Aldridge | 2/93 X |

FOREIGN PATENT DOCUMENTS

| | | | |
|---|---|---|---|
| 0560743 | 9/1957 | Belgium | 2/51 |
| 0307715 | 9/1987 | European Pat. Off. | 2/49 R |
| 886132 | 7/1953 | Fed. Rep. of Germany | 2/46 |
| 693521 | 11/1930 | France | 2/51 |
| 1298698 | 8/1961 | France | 2/51 |
| 1568081 | 5/1980 | United Kingdom | 482/105 |

OTHER PUBLICATIONS

Elmer's Publication "Elmer's Original Weight-s—You-Wear"—1985.

*Primary Examiner*—Clifford D. Crowder
*Assistant Examiner*—Jeanette E. Chapman

[57] ABSTRACT

An apron that may be worn by the driver of a vehicle protects his clothing from spilled food or beverage, or falling cigarette or cigar ashes, while he is eating and/or smoking as he is driving. The apron can be put on and taken off with one hand making a single connection. It comprises a torso panel and a lap panel, the former removably connected to a neck strap. The lap panel covers the thighs and knees. The sides of the lap panel are stiffened by weights maintaining the lap panel flat on the thighs and preventing it from creeping up over the knees despite the movement of the driver's legs as he operates the pedals of the vehicle. The apron is made of water-repellent, moisture-breathing, fire retardant fabric.

8 Claims, 2 Drawing Sheets

DRIVER'S APRON

BACKGROUND OF THE INVENTION

1. Field of Invention

This invention relates to an apron for protecting clothes from soiling by food and beverages and from burning by cigarette or cigar ashes. More specifically, the invention pertains to a driver's apron for use while driving a vehicle.

2. Prior Art

Many drivers of automobiles and trucks eat, drink beverages, and smoke while driving. Many fast-food chains have "drive-through" sections where customers do not leave their vehicle to buy and consume food and beverages. Inevitably, food and beverages are spilled on the driver's clothing and/or the front seat of the vehicle. Cigarette and cigar ashes may burn the driver, burn holes into the driver's clothing or the front seat of the vehicle, startle the driver and cause accidents. Therefore, there is a need for an apron which can be easily put on by the driver while operating the vehicle and which can provide protection against such mishaps.

Aprons are well known for protection against soil. U.S. Pat. No. 4,660,224 discloses a throw-away bib-apron for travelers who eat in their vehicles. It requires both hand of the wearer to put on. The apron is made of paper. Since it cannot easily be put on with one hand, the driver must stop the vehicle to put the apron on. Furthermore, it is not fire-proof, affording no protection against burns and potential accidents caused by falling cigarette and cigar ashes.

SUMMARY OF THE INVENTION

The apron in accordance with this invention is so designed that a driver of a vehicle is able to put the apron on with one hand, thus enabling him to do so while driving a vehicle without releasing the steering wheel. The apron is made from a fire retardant, water repellent fabric which furthermore can breathe to provide comfort as well as protection.

The apron of this invention is constructed of two rectangular panels of fabric, a torso panel and a lap panel connected thereto, and a neck strap. The strap has one fixed fastening pad at one end and an adjustable fastening pad on the other end for attachment to fastening pads affixed to the torso panel at its top edge. At the ends of the lap panel, there are provided casings for insertion of weights such as metal pipes or rods so as to maintain the lap panel well extended and closely draped over the driver's thighs and knees despite the movement of the driver's legs in operating the pedals of the vehicle. The apron of this invention thus protects the driver's clothing and the seat of the vehicle from soil and burns and avoids distracting the driver during the operation of the vehicle. These and other objects will be readily evident upon a study of the following specification and the accompanying drawings.

DESCRIPTION OF THE PREFERRED EMBODIMENT OF THE INVENTION

Figure 1:
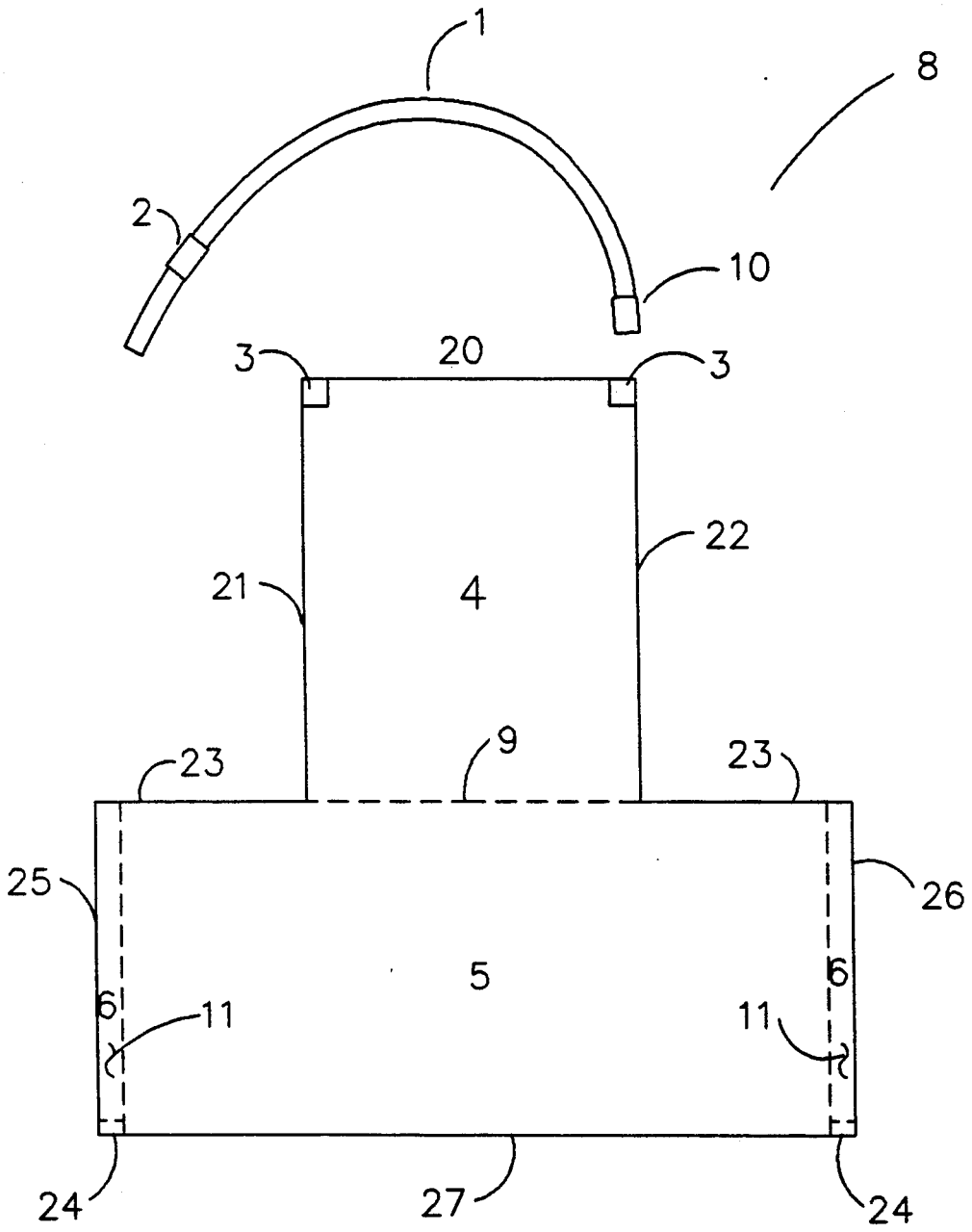
FIG. 1 is a detailed plan view of the apron.
Figure 2:
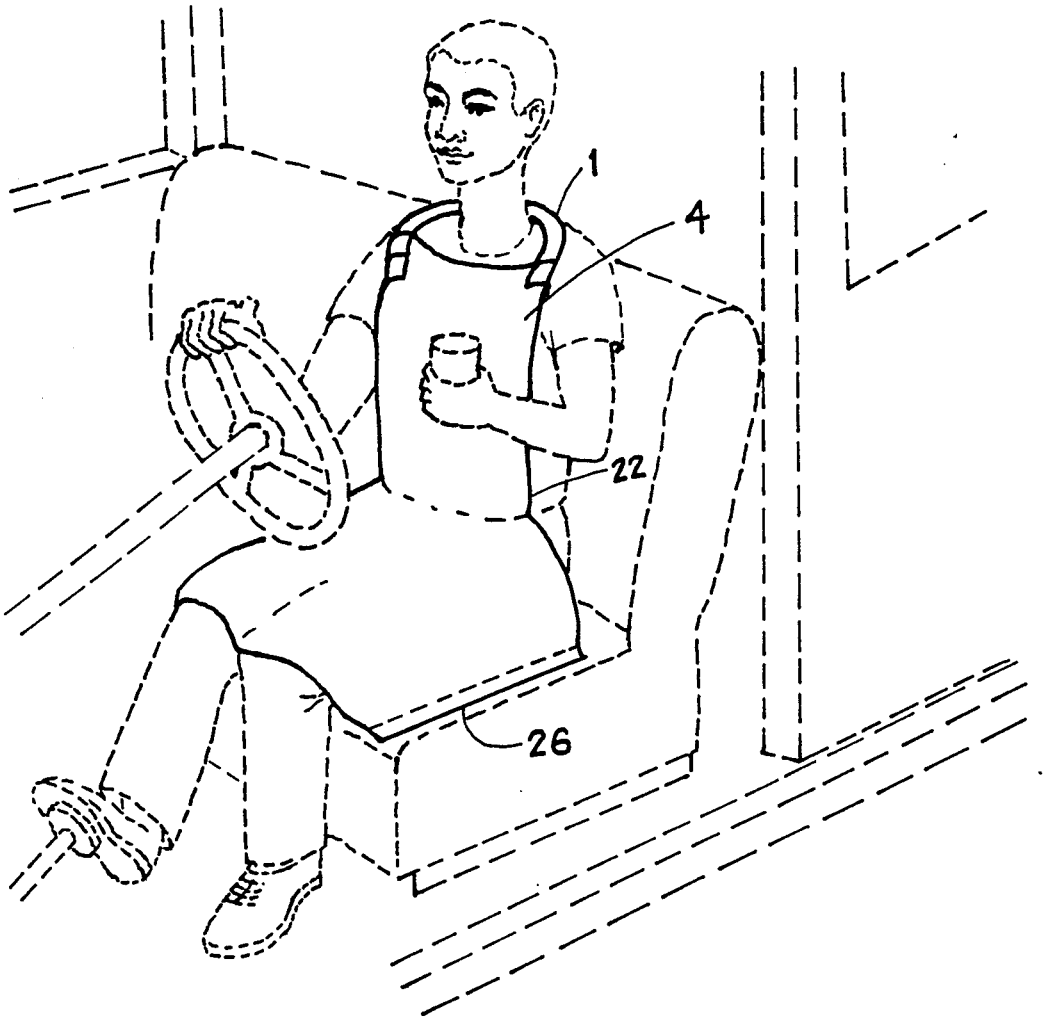
FIG. 2 is a perspective view of a driver wearing the apron.

Refering to FIG. 1, an apron is constructed of an upper portion, a torso panel 4, of generally a rectangular shape, about 12"×15", the short sides being the neck line 20, and waist line 9, and the long sides, 21 and 22, being along the length of the torso.

A lower portion of the apron, lap panel 5, of generally rectangular shape having a width greater than its length, is about 27" by 12" long. The waist line 9, of the torso panel is connected to the mid-portion of the long edge of the lap panel 5, with an equal portion of the edge 23, extending beyond either side of waist line 9. These two panels may be sewn together as shown or may be cut from fabric as one piece. The dimensions of the panels and their method of joining are not critical. The apron is preferably made of a water-proof and breathable fabric, such as Gore-Tex ®, and it is preferably made of polymeric fiber with fire retardant properties, such as organic polyimides or polymers having halogenated compounds such as aliphatic bromides incorporated in them, or the fabric is treated with chemicals which impart fire-retardant properties, such as a mixture of borax (sodium borate) and boric acid. Alternatively, the fabric may consist of terry cloth impregnated with fire-retardant chemicals over a breathable, water-repellent fabric. The water-proof, breathable material is named Gore-Tex ®, and is available from W. L. Gore & Associates, Inc., 100 Airport Road, Elkton, Md. 21922. Fabrics having the above properties are known to the art.

At both lateral edges, 25 and 26, of the lap panel 5, there are provided casings 6, which may be made by folding a strip of material along the lateral edges and sewing it onto the panel. The casings are wide enough to hold a rigid elongated weight 11 such as a metal pipe or rod about ½" in diameter. Other weights such as metal pellets or balls may also be used. One end of each casing preferably is closed to prevent the weights from slipping out, and the other end is open to allow insertion of the weights. These open ends should be capable of being closed by snaps, velcro pads, or other suitable means known to the art to prevent the weights from slipping out of the casings at the other ends.

At the two corners of the neck line, 20, of the torso panel 4, there are provided two fastening pads 3 of velcro.

A neck strap 1 has a length of about 16". One end is provided with a velcro fastening pad 10 to be attached to either fastening pad on the torso panel 3. The other end of the strap 1 is provided with an adjustable fastening pad 2 of velcro. The adjustable fastener may be a belt buckle which may be slid along the neck strap 1 to adjust the size of the loop formed by the neck strap according to the neck size of the driver. The velcro of pads 3 are the hook type, and the mating pads 2 and 10 are the pile type, or vice versa.

It will be appreciated that the neck strap so designed offers the the wearer the choice to don the apron either with his right or his left hand. When the fixed fastening pad 10 is attached to pad 3 either on the left or the right side of the torso panel, only one hand is needed for attaching pad 2 to the other fastening pad 3.

The rigidity of weights such as pipes or rods inserted in the casings keep the lap panel extended over the knees and maintain the lap panel in place on the driver's lap in spite of the movement of the driver's legs in operating the pedals of the vehicle. The weights inserted along the sides of the lap panel also prevent the apron from creeping up over the driver's knees.

While the apron of this invention has been described with specific reference to the driver of a vehicle, it is equally convenient for the passengers riding in the vehicle, or for riders in a train.

In addition to the ease with which the driver may put on the apron with one hand, the driver may also utilize the weights to fold or roll up the apron. The apron in accordance with this invention thus can be put on or taken off without visual distraction of the driver. In conclusion, the apron according to this invention is novel and has many advantages over aprons of the prior art.

Numerous modifications and variations of the present invention are possible in light of the above teaching and therefore, within the scope of the appended claims, the invention may be practiced otherwise than as particularly described.

What is claimed is:

1. A driver's apron for protecting a driver's clothing and vehicle seat from soil and burns comprising:

(a) a torso panel of generally rectangular shape, having short sides for neck and waist lines;

(b) a lap panel of generally rectangular shape having a width greater than its length, said width being along its long edges and the length being along its lateral edges, and the waist line of the torso panel being connected to a mid-section of a long edge of the lap panel;

(c) two lateral edges of the lap panel being provided with casings for insertion therein of weights; wherein one end of each casing is closed and an opposing end of each casing has a means for closing it;

(d) fastening pads attached to ends of the neck line; and (e) a neck strap having one fixed fastening pad at one end and one adjustable fastening pad on the opposing end of the strap for fastening to the fastening pads attached to the neck line of the torso panel.

2. The apron of claim 1 wherein the weights are selected from the group consisting of metal pipes, rods, and pellets.

3. The apron of claim 1 wherein the fastening pads are hook and loop fasteners.

4. The apron of claim 1 is made of a breathable, water-repellent, and fire-retardant fabric.

5. The apron of claim 1 wherein the adjustable fastening pad is a belt buckle covered with the fastening pad and is capable of being slid along the strap.

6. The apron of claim 4 wherein the fire retardant fabric is terry cloth, impregnated with fire retardant chemicals, over a breathable, water-repellent fabric.

7. The apron of claim 1 wherein the closing means are snaps.

8. The apron of claim 1 wherein the closing means are hook and loop fastener pads.

* * * * *